US010293616B2

(12) United States Patent
Jacobs

(10) Patent No.: US 10,293,616 B2
(45) Date of Patent: May 21, 2019

(54) INK HEATING DEVICE AND INK SUPPLY SYSTEM FOR A PRINTING APPARATUS

(71) Applicant: Océ Holding B.V., Venlo (NL)

(72) Inventor: Roy H. R. Jacobs, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/018,941

(22) Filed: Jun. 26, 2018

(65) Prior Publication Data

US 2019/0047294 A1 Feb. 14, 2019

Related U.S. Application Data

(63) Continuation of application No. PCT/EP2017/050475, filed on Jan. 11, 2017.

(30) Foreign Application Priority Data

Jan. 11, 2016 (EP) ..... 16150779

(51) Int. Cl.
*B41J 2/175* (2006.01)

(52) U.S. Cl.
CPC ..... *B41J 2/17593* (2013.01)

(58) Field of Classification Search
CPC .... B41J 2/175; B41J 2/17593; B41J 2/17513; B41J 2/17523; B41J 2/17553; B41J 2/17559
See application file for complete search history.

(56) References Cited

U.S. PATENT DOCUMENTS 4,961,082 A * 10/1990 Hoisington ..... B41J 2/19 347/88
5,341,162 A * 8/1994 Hermanson ..... B41J 2/175 347/89

(Continued)

FOREIGN PATENT DOCUMENTS

EP 1 262 325 A1 12/2002
EP 1 543 980 A1 6/2005
EP 2 216 177 A1 8/2010

OTHER PUBLICATIONS

International Search Report (PCT/ISA/210) issued in PCT/EP2017/050475, dated Mar. 27, 2017.

(Continued)

*Primary Examiner* — Anh T Vo
(74) *Attorney, Agent, or Firm* — Birch, Stewart, Kolasch & Birch, LLP

(57) ABSTRACT

An ink supply system for supplying ink to a drop-forming unit of a print-head in a printing apparatus includes a reservoir for holding or storing a volume of liquid ink to be supplied to a drop-forming unit in a print-head, and a heating device arranged upstream of the reservoir for heating the ink to an desired operating temperature. The heating device includes a heating body for transferring heat to the ink, wherein the heating body includes a plurality of channels which extend from an top side of the heating body to an bottom side of the heating body for conveying the ink to the reservoir, whereby the ink is heated via contact with walls of the channels. The heating body typically includes a substantially monolithic body of a highly thermally conductive material and the plurality of channels are substantially parallel channels which extend through the heating body. A print-head of a printing apparatus incorporating the ink supply system, and a heating device are also disclosed.

20 Claims, 3 Drawing Sheets

(56) References Cited

U.S. PATENT DOCUMENTS

| | | | | |
|---|---|---|---|---|
| 5,621,444 | A | 4/1997 | Beeson | |
| 5,881,646 | A * | 3/1999 | Nagata | B41J 2/06 101/487 |
| 6,007,193 | A * | 12/1999 | Kashimura | B41J 2/1707 347/18 |
| 6,213,596 | B1 * | 4/2001 | Nowell, Jr. | B41J 2/17503 347/85 |
| 6,817,705 | B1 * | 11/2004 | Crockett | B41J 2/18 347/85 |
| 2005/0185032 | A1 | 8/2005 | Slotto et al. | |
| 2006/0007281 | A1 | 1/2006 | Sonnichsen et al. | |
| 2010/0194834 | A1 | 8/2010 | Jones | |
| 2011/0141212 | A1 * | 6/2011 | Smith | B41J 2/17593 347/88 |
| 2011/0180526 | A1 | 7/2011 | Wayman et al. | |

OTHER PUBLICATIONS

Written Opinion (PCT/ISA/237) issued in PCT/EP2017/050475, dated Mar. 27, 2017.

* cited by examiner

INK HEATING DEVICE AND INK SUPPLY SYSTEM FOR A PRINTING APPARATUS

CROSS REFERENCE TO RELATED APPLICATIONS

This application is a Continuation of PCT International Application No. PCT/EP2017/050475, filed on Jan. 11, 2017, which claims priority under 35 U.S.C. 119(a) to patent application Ser. No. 16/150,779.3, filed in Europe on Jan. 11, 2016, all of which are hereby expressly incorporated by reference into the present application.

CROSS REFERENCE TO RELATED APPLICATIONS

This application is a Continuation of PCT International Application No. PCT/EP2017/050475, filed on Jan. 11, 2017, which claims priority under 35 U.S.C. 119(a) to patent application Ser. No. 16/150,779.3, filed in Europe on Jan. 11, 2016, all of which are hereby expressly incorporated by reference into the present application.

FIELD OF THE INVENTION

The present invention relates to a heating device for heating ink in an ink supply system of a printing apparatus and to an ink supply system for supplying ink to a drop-forming unit of a print-head in a printing apparatus. The invention also relates to a print-head as well as to a printing apparatus that includes such an ink supply system.

BACKGROUND OF THE INVENTION

The present invention and the problem upon which it is based will be explained in greater detail with reference to printing apparatuses that employ ink that is melted to a liquid state. More specifically, the ink is liquid at an elevated temperature and is generated by melting solid ink elements, such as toner pearls (i.e. so called "hot-melt" ink). In such a printing apparatus, in which the print-head uses hot-melt ink, the melted liquid ink is supplied from an ink reservoir to a drop-forming unit of the print-head. In such conventional print-head arrangements for hot-melt ink, the ink passes through and is heated in channels having a length of about 10 mm per print-head nozzle, just before the ink reaches the nozzle plate.

With more recent developments, modern drop-forming units employ micro-electro-mechanical systems (MEMS) provided on a chip, which can be supplied at high ink flow rates. In such MEMS chips, however, the ink channel is only about 1 mm long per nozzle, but the ink flow per nozzle remains unchanged. As a result, the heat transfer efficiency for heating the ink to the desired printing temperature in a MEMS print-head is very low. It therefore becomes necessary to deliver the ink to the chip in a MEMS print head with a much smaller temperature range than is the case for conventional hot-melt ink print-head arrangements to achieve the same temperature range and temperature gradient in the print-head nozzle. In contrast to conventional hot-melt ink print-heads, which have their own temperature sensor and heater, MEMS chips are not equipped with a temperature sensor or heater. As such, the temperature of the ink in the channel of the chip is far more difficult to control. The lack of temperature control in a MEMS chip means that a temperature range of the ink delivered to the chip has to be correspondingly narrower. In particular, for good ink drop quality (i.e. small drop volume variation) at the drop-forming unit, it is important that temperature variation over time and the gradients over the location of the ink in the MEMS chip are small.

In other words the uniformity of the temperature of ink entering a printhead having relatively short ink channels (e.g. a MEMS printhead) needs to be high in order to provide good drop quality which is also more or less constant in time.

The same holds for other ink types that need to be heated before being printed. Therefore, the present invention is not limited for use with hot-melt inks.

It is therefore an object of the present invention to provide a new and improved heating device for heating ink in an ink supply system as well as a new and improved ink supply system for supplying ink to a drop-forming unit in a print-head of a printing apparatus. The heating device according to the present invention enables high ink throughput and high temperature uniformity of the heated ink.

SUMMARY OF THE INVENTION

In a first aspect of the present invention, the object is at least partly achieved by a heating device for heating liquid ink in an ink supply system of a printing apparatus, the heating device comprising:

- a heating body for transferring heat to liquid ink in contact with the heating body,
- wherein the heating body comprises an essentially solid body of thermally conductive material and includes a plurality of generally parallel channels formed therein which extend from a top side of the heating body to a bottom side of the heating body,
- wherein the heating body comprises a receptacle at the top side for receiving the liquid ink, wherein an inlet opening of each of the plurality of substantially parallel channels is formed in a base of the receptacle,
- wherein the heating device comprises a passage arranged separated from the receptacle and to provide a fluid connection between the top side and the bottom side of the heating body, which passage in operation provides pressure equalization between the top side and the bottom side of the heating body,
- and wherein the plurality of substantially parallel channels are arranged to, in operation, convey the liquid ink from the top side to the bottom side of the heating body whereby the ink is heated via contact with walls of the channels.

The heating body includes or forms a receptacle, such as a basin or trough, at the top side for receiving the liquid ink. In this regard, an inlet opening of each of the plurality of substantially parallel channels is formed in a base of the receptacle. That is, the base of the receptacle (e.g. basin or trough) provided at the top side of the heating body for receiving the liquid ink is typically covered with an array of inlet openings (e.g. in the range of 100 to 500) for inlet or admission of the ink into the plurality of channels. Because the heating body is typically a solid body of highly thermally conductive material (for example, a metal such as copper or aluminum, or any suitable alloy thereof), the heating body will typically also transfer heat to the ink as the ink resides in receptacle and before the ink is conveyed through the plurality of channels.

Preferably the receptacle is an integral part of the heating body.

The heating device comprises a passage which provides pressure equalization between the top side and the bottom side of the heating body. The passage may, for example, be formed in the heating body in the manner of a through-hole. By providing minimal pressure difference between the space above the heating body at the top side and the space below the heating body at the bottom side, the driving force for ink flow is liquid column height of the ink (e.g. the depth of the ink in the receptacle, basin or trough at the top side). The diameter of the channels then determines the flow rate. The length of the channels is essentially irrelevant for the ink flow rate (although it of course contributes to the heat exchanging surface area), because if the channel length doubles, the effect of an increased column height of the ink is offset by an increased flow resistance.

Preferably the passage which provides pressure equalization between the top side and the bottom side of the heating body is an integral part of the heating body.

In this way, the heating device of the invention is configured and arranged to heat the ink to a predetermined desired operating temperature prior to the ink being supplied or delivered to the drop-forming unit in the print-head. That is, the inventors have developed a heating device which delivers the ink in the print-head in the narrow temperature range required for print-heads comprising relatively short ink channels and/or no temperature control in the drop-forming unit, e.g. MEMS-type print-heads. That is, the heating device of the invention is configured and arranged to heat the ink earlier in the ink path upstream of the drop-forming unit. The invention therefore provides an alternative for long meandering heating channels, but relies upon a heat exchange capability of each of the channels being substantially equal. Thus, the residence time per channel should be substantially equal to obtain uniform ink heating. In other words, each channel should heat the same amount of ink per unit of time, assuming equal flow through each channel. Each of the channels should therefore provide for the same, preferably substantially constant, ink flow. This is obtained with a heating device in accordance with the present invention comprising a heating body that is arranged such that in operation ink flows from the top side of the heating body to the bottom side of the heating body under the influence of gravity. In operation the receptacle contains an amount of ink creating a liquid column above each channel. The passage arranged separated from the receptacle provides a fluid (i.e. air) connection between the top side and the bottom side of the heating body, which passage in operation provides pressure equalization between the top side and the bottom side of the heating body, such that substantially equal flow through each channel is obtained, which flow is substantially solely determined by the liquid column above the channel. Preferential ink flow is therefore prevented. Due to the fact that substantial equal ink flow through each channel is obtained, the residence time of ink in each channel is substantially equal and all ink will have substantially the same contact time with the heating body. Because the heating body is made of a thermally conductive material, the temperature uniformity of the heating body will be very good. Considering the above reasoning, despite using multiple parallel ink channels, the temperature uniformity of the ink exiting the heating device will show excellent temperature uniformity.

In an embodiment, each of the plurality of substantially parallel channels has a length in the range of about 3 mm to about 10 mm, and more preferably in the range of about 4 mm to about 8 mm; for example, about 5 mm.

In an embodiment, each of the plurality of substantially parallel channels has a diameter in the range of about 0.2 mm to about 1.0 mm, and more preferably in the range of about 0.4 mm to about 0.8 mm; for example, about 0.5 mm.

In an embodiment, the number of the plurality of substantially parallel channels formed in the heating body is in the range of about 100 to about 500, and more preferably in the range of about 200 to about 400; for example, about 300. The cross-sectional shape or geometry of each of the channels is not limited and may be selected as appropriate, e.g. depending on a manufacturing method. For example, although the channels could conceivably have a polygonal cross-section (e.g. square or triangular), each of the channels is preferably round or circular in cross-section. By carefully selecting the dimensions (e.g. length and diameter) of the channels as well as the number of channels, it is possible to design or tailor the heating body to transfer the required amount of heat to the ink over the length of the channels (i.e. via the channel walls) in order for the ink to reach the desired predetermined temperature. In this regard, it will be appreciated that 300 individual channels having a length of 5 mm may be equivalent in heat transfer capacity to a channel length of 1500 mm.

According to a second aspect, the present invention provides an ink supply system for supplying ink to a drop-forming unit of a print-head in a printing apparatus. The ink supply system comprises: a reservoir for holding a volume of liquid ink to be supplied to a drop-forming unit in a print-head; and a heating device according to the first aspect of the present invention which heating device is arranged upstream of the reservoir for heating the ink to a desired operating temperature. The heating device comprises a heating body for transferring heat to the ink. The heating body comprises a plurality of channels which extend from a top side of the heating body to a bottom side of the heating body for conveying the liquid ink to the reservoir, whereby the ink is heated via contact with walls of the channels.

In an embodiment, the heating body comprises a substantially monolithic or solid body of a highly thermally conductive material. For example, a metal such as copper, aluminum, or an alloy of copper or aluminum may be particularly suitable for the heating body. Furthermore, the plurality of channels provided in the heating body are preferably substantially parallel channels.

In an embodiment, the ink supply system comprises a filter device which is arranged between the heating device and the reservoir. In particular, the filter device is preferably arranged at the bottom side of the heating body adjacent an inlet to the reservoir in order to filter the hot-melt ink before it enters the reservoir chamber. In this way, the inadvertent introduction of particles or contaminants into the reservoir can be substantially avoided. Further, the heating device elevates the temperature of the ink upstream of the filter device such that the heated ink has a reduced viscosity and thus flows more readily through the filter device. This results in higher ink flow rates in the ink supply system and/or enables a more compact construction of the heating device. If the ink flow rate is increased, the ink supply system becomes very suited to use with modern drop-forming units, and especially drop-forming units that employ micro-electro-mechanical systems (MEMS).

In an embodiment, the ink supply system comprises a melting device for melting solid ink elements, such as toner pearls. The melting device is preferably arranged upstream of the heating device for providing liquid ink to the heating device before the ink enters the reservoir. In this way, the heating device may be directly fed with liquid ink of the hot-melt type at a first temperature, and the freshly melted ink is then heated to a second operating temperature via the heating body of the heating device. This ensures the hot-melt ink is already within a desired narrow temperature range in the reservoir for supply to the drop-forming unit of the print-head. The optional filter device arranged between the heating device and the reservoir prevents non-melted ink particles being admitted to the reservoir.

As noted above, each of the channels provided in the heating body preferably has a length in the range of about 3 mm to about 10 mm, and more preferably in the range of about 4 mm to about 8 mm; e.g. about 5 mm. Furthermore, each of the channels preferably has a diameter in the range of about 0.2 mm to about 1.0 mm, more preferably in the range of about 4 mm to about 8 mm; e.g. about 0.5 mm. The number of channels formed in the heating body is in the range of about 100 to about 500, preferably about 300. By carefully selecting the dimensions (e.g. length and diameter) of the channels as well as the number of the channels, it is possible to design or tailor the heating body to transfer the required amount of heat to the ink over the length of the channels via the channel walls.

In a preferred embodiment, the heating body includes or forms a receptacle, such as a basin or trough, at the top side for receiving the liquid ink, e.g. from a melting device. As described above, an inlet opening of each of the channels is typically formed in a base of the receptacle for guiding or directing the liquid ink directly into the channels from the basin or trough.

In a preferred embodiment, the ink is not driven or forced through the channels of the heating body under pressure. Rather, the heating device preferably comprises at least one passage which provides pressure equalization between the top side and the bottom side of the heating body. The passage may, for example, be formed in the heating body, e.g. in the manner of a through-hole. By providing minimal pressure difference between a space above the heating body at the top side and a space below the heating body at the bottom side, gravity acts as the driving force for ink flow, i.e. the liquid column height or depth of the ink in the receptacle at the top side.

According to a third aspect, the invention provides a print-head for a printing apparatus, comprising: an ink supply system according to any of the embodiments described above (second aspect); and a drop-forming unit which is supplied with ink from an outlet of the reservoir of the ink supply system.

In a particular embodiment, the drop-forming unit comprises a micro-electro-mechanical system (MEMS), and especially a MEMS provided on a chip.

In an embodiment, a second filter device is provided or configured to filter the ink supplied by the ink supply system upstream of the drop-forming unit. In this regard, the second filter device is preferably arranged between the outlet of the ink reservoir and the drop-forming unit.

According to a fourth aspect, the present invention provides a printing apparatus comprising an ink supply system according to any of the embodiments described above (second aspect) and/or a print-head according to any of the embodiments described above (third aspect). The printing apparatus may employ ink that is melted to a liquid state (i.e. so called "hot-melt" ink) which is generated by melting solid ink elements, such as toner pearls.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
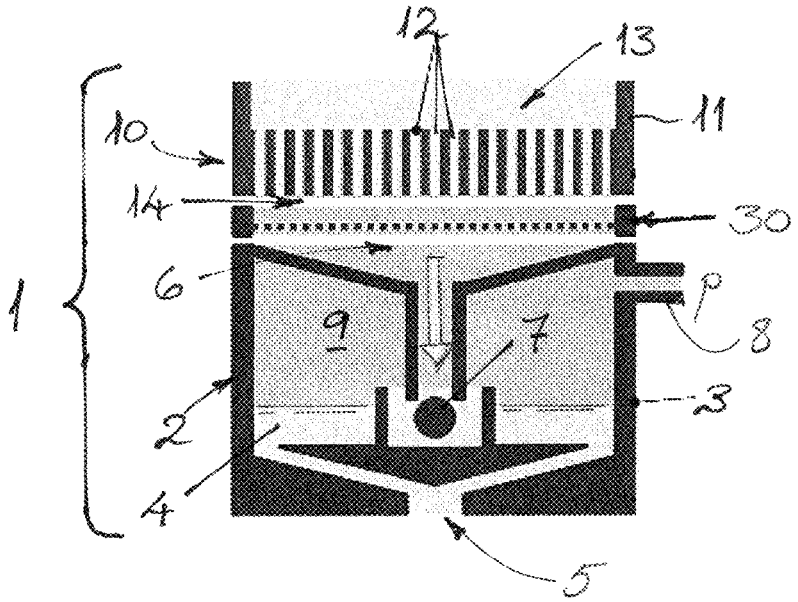
FIG. 1 is a schematic cross-sectional side view of an ink supply system according to a preferred embodiment.

With reference firstly to drawing FIG. 1, an ink supply system 1 for supplying ink to a drop-forming unit (not shown) in a print-head 50 of a printing apparatus. The ink supply system 1 includes a reservoir 2 which is enclosed by a housing 3 for storing or holding a volume of liquid ink 4 to be supplied to the drop-forming unit of the print-head via an outlet 5 of the reservoir 2. The specific configuration of the reservoir 2 is not itself central to the concept of the ink supply system 1 in this embodiment and will therefore not be described here in detail. The ink supply system 1 further includes a heating device 10 which is arranged upstream of the reservoir 2 for heating the liquid ink 4 to a desired operating temperature.

Figure 2:
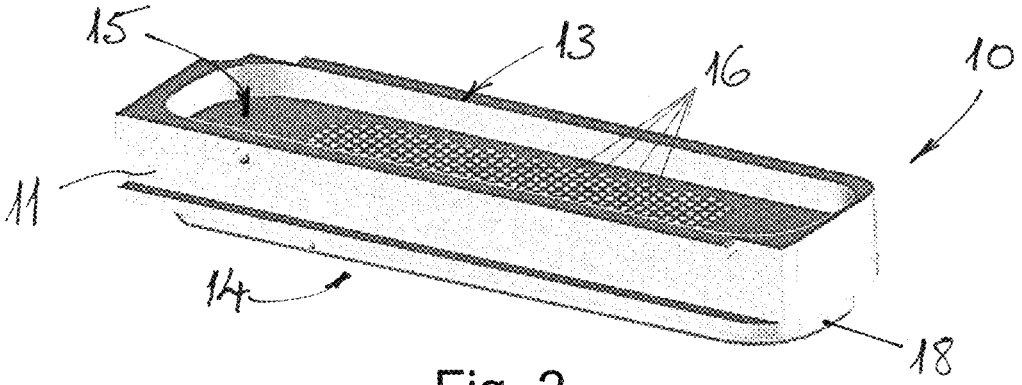
FIG. 2 is a perspective view of a heating device according to a preferred embodiment.
Figure 3:
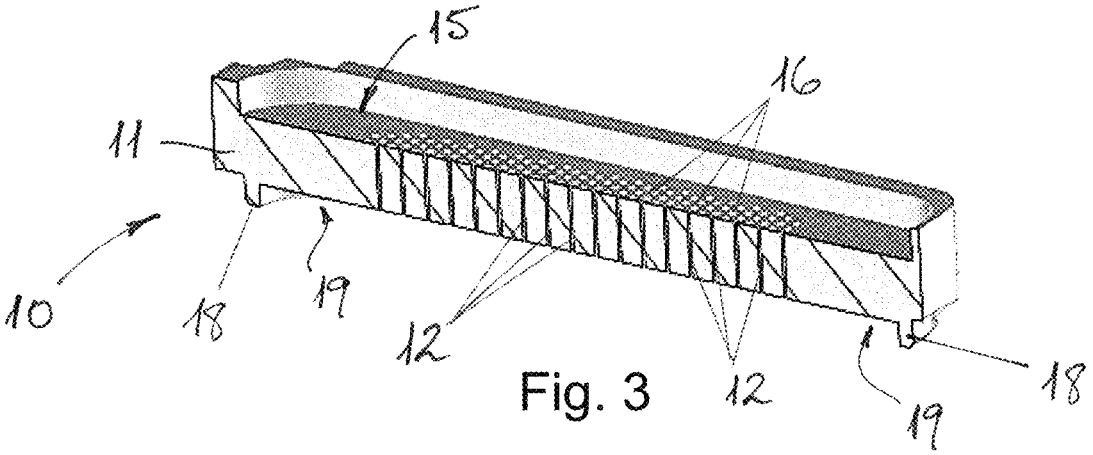
FIG. 3 is a cross-sectional perspective view of the heating device shown in FIG. 2.

With reference now also to FIGS. 2 and 3 of the drawings, the heating device 10 comprises a heating body 11 for transferring heat to the liquid ink 4 in contact with the heating body 11. In this regard, the heating body 11 comprises an essentially solid body or block of a highly thermally conductive material, such as copper or aluminum or a respective alloy thereof. The heating body or block 11 includes an array of generally parallel channels 12 formed therein which extend from an top side 13 of the body 11 to an bottom side 14 of the body 11. Each of the channels 12 comprises a circular bore and all of the channels 12 have substantially the same dimensions; namely a diameter of about 0.5 mm and a length of about 5 mm. The heating body or block 11 of this embodiment has 300 channels 12 formed therein for conveying the liquid ink 4 from the top side 13 to the bottom side 14, with the ink being heated by contact with the heating body or block 11, and particularly with walls of the channels 12 as the liquid ink passes through the channels.

Figure 4:
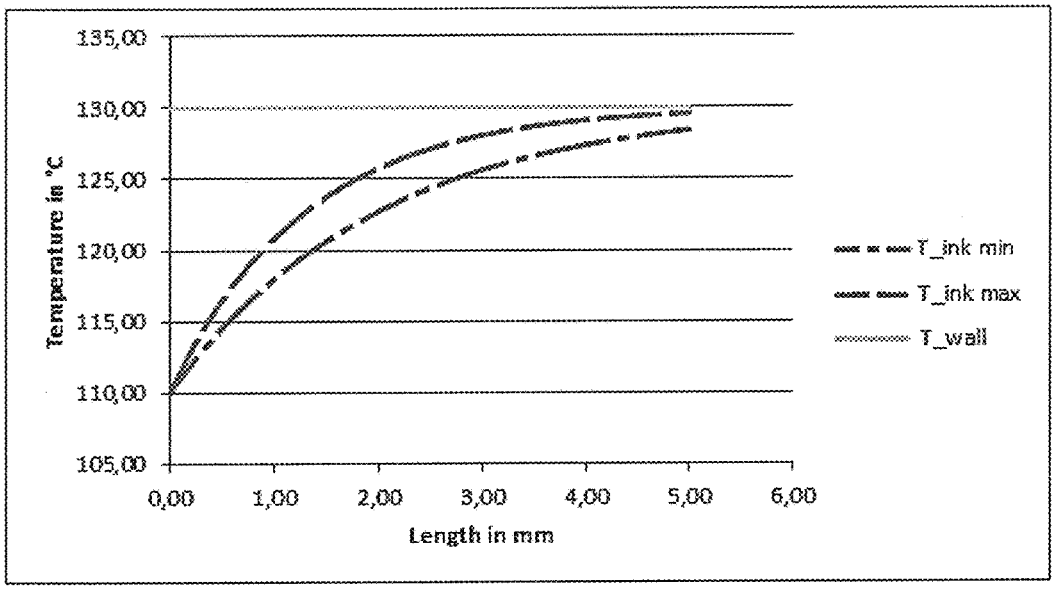
FIG. 4 is a graph comparing a maximum and minimum temperature of the ink with a wall temperature over a length of the channel in the heating body of a heating device according to a preferred embodiment.
Figure 5:
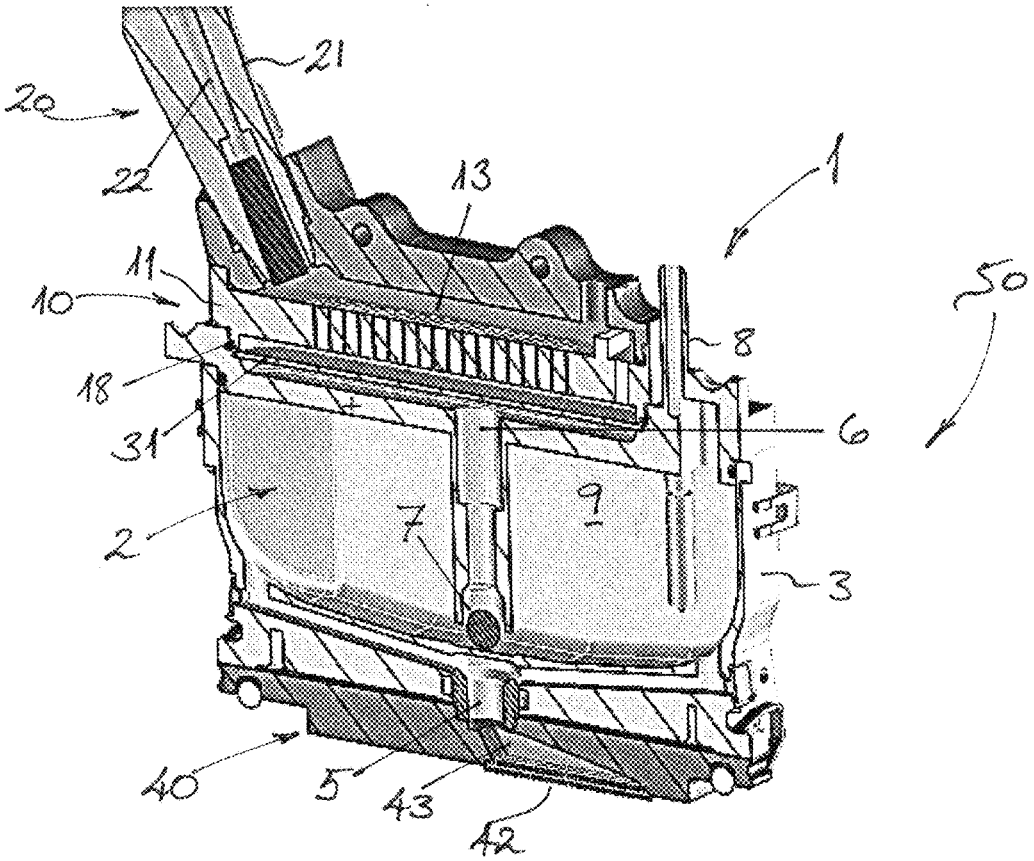
FIG. 5 is a cross-sectional perspective view of a print-head for a printing apparatus according to a preferred embodiment.

Referring now to drawing FIGS. 4 and 5 together with FIGS. 1 to 3, the liquid ink 4 having a first temperature (e.g. 110° C.) is delivered to the heating device 10 at the top side 13 of the heating body 11 from a melting device 20. In this regard, the melting device 20 includes a tapered tube 21 within which solid ink elements, such as spherical toner pearls (not shown), are heated to the first temperature such that they melt. The hot-melt ink 4 therefore flows down through a central cavity 22 of the heated tube 21 into a receptacle 15 which is provided the top side 13 of the heating body or block 11 in the form of a generally rectangular basin or trough. In particular, the rectangular basin or trough 15 can be seen in FIGS. 2 and 3 to be formed integrally with the generally solid body or block 11 of thermally conductive material. Because the heating body 11 is heated to a second temperature which is higher than the first temperature (e.g. 130° C.), when the ink 4 flows into the basin or trough 15 at the top side 13 and comes into contact with the heating body 11, it will begin to be heated further by the heating device 10. As can be seen in FIG. 2 and FIG. 3, each of the channels has a respective inlet opening 16 in a base of the trough 15, such that the ink may then flow directly into the channels 12.

The graph in FIG. 4 plots the change in temperature of the ink (T_ink) as it passes along the length of each channel 12. In particular, FIG. 4 shows curves for both the minimum temperature of the ink (T_ink min) and the maximum temperature of the ink (T_ink max) tested for a constant wall temperature (T_wall) of 130° in each channel 12. Thus, even with the minimum or worst result, the heating device 10 of the ink supply system 1 still elevates the temperature of the liquid ink 4 to within 1.6° of the wall temperature, as summarised in Table 1 below.

TABLE 1

Overview of heating device performance

| Overview | | | |
|---|---|---|---|
| Ink Temperature input | T_ink_in | 110 | ° C. |
| Ink Temperature output | T_ink_out | 128.4 | ° C. |
| Heat transfer effectiveness | ε | 92% | |
| Temperature error | T_err | | ° C. |
| Wall temperature | T_wall | | ° C. |
| Total channel length | L_tot | 1500 | mm |
| — | — | round | — |
| Nusselt number | Nu | 3,657 | — |

Figure 6:
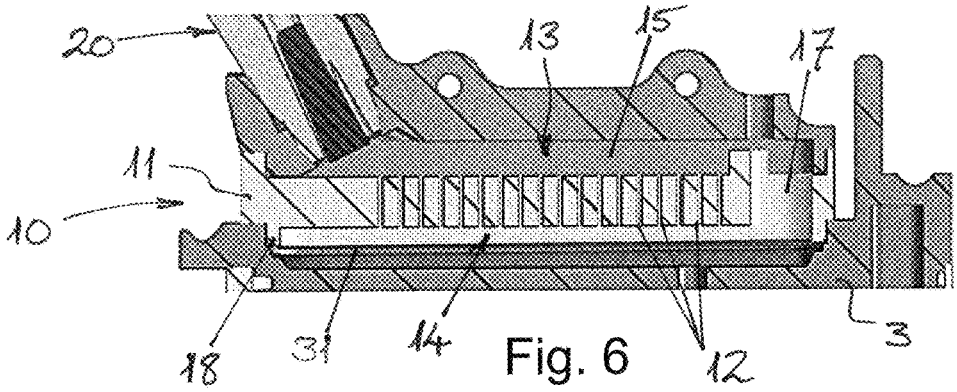
FIG. 6 is a detailed cross-sectional perspective view of the heating device in the print-head of FIG. 5.

With particular reference now to FIGS. 5 and 6 of the drawings, it will be noted that the heating device 10 includes a passage or through-hole 17 to provide pressure equalization between the top side 13 and the bottom side 14 of the heating body or block 11. In this way, minimal pressure difference exists between the space above the heating block 1 and the space below the heating block 11, such that gravity or liquid column height of the ink in the basin or tough 15 acts as the driving force for ink flow through the channels 12.

As is apparent from FIG. 1 and FIG. 5, the ink supply system 1 comprises a filter device 30 which is arranged between the heating device 10 and the reservoir 2. In particular, the filter device 30 comprises a filter member or mat 31 (e.g. comprised of stainless steel fibres or stainless steel "wool") arranged at the bottom side 14 of the heating body or block 11 and extending across a full expanse of the heating block 11 immediately adjacent to an inlet 6 to the reservoir 2. As can be seen in FIG. 3 and FIGS. 5 and 6, the heating block 11 has a downwardly projecting rim 18 which cooperates with the housing 3 above the reservoir 2 to clamp or hold the filter member or mat 31 in position. The rim 18 also produces a small cavity 19 at the bottom side 14 of the block 11 which allows the ink to spread across the filter member 31. Accordingly, the filter device 30 acts to filter the hot-melt ink 4 before it enters the reservoir chamber 2 to prevent unwanted introduction of particles or contaminants into the reservoir 2. Because the heating device 10 elevates the temperature of the ink upstream of the filter device 30, the ink 4 has a relatively reduced viscosity and thus flows more readily through the filter device 30, enabling higher ink flow rates in the ink supply system 1 or a more compact construction of the heating device 10. By increasing the number of channels 12, the flow rate may also be increased and/or the device 10 can be made more compact. If the ink flow rate is increased, the ink supply system 1 becomes very suited to use with modern drop-forming units, and especially drop-forming units that employ micro-electro-mechanical systems (MEMS).

The inlet 6 of the reservoir 2 includes valve means 7 (e.g. formed as a float-type check valve) for controlling admission of the ink 4 into the reservoir 2 and preventing back-flow of the ink during a purge of the reservoir 2. In this regard, the ball-float of the valve 7 can move vertically downwards to an open position (as shown) under the influence of a liquid ink head or column height above the valve means 7 to admit the ink 4 to the reservoir. Further, by increasing the pressure p applied to the reservoir 2 inside the housing 3 via a port 8 during a purge of the reservoir, the ball-float of the valve means 7 can move upwards to a closed position to prevent back-flow of the ink 4 through the inlet 6. A level sensor (not shown) may control the level of the ink in the reservoir 2 such that a free space 9 remains above the ink level 4 in the reservoir. Because the heating device 10 of this embodiment is arranged in the ink supply system 1 above the level of the reservoir 2, the possible presence of air bubbles in the ink 4 passing though the heating body or block 11 is not critical. Specifically, any air bubbles present in the ink will have an opportunity to escape into the free space 9 above the level of the ink 4 before the ink is conveyed via the outlet 5 to a drop-forming unit.

Figure 7:
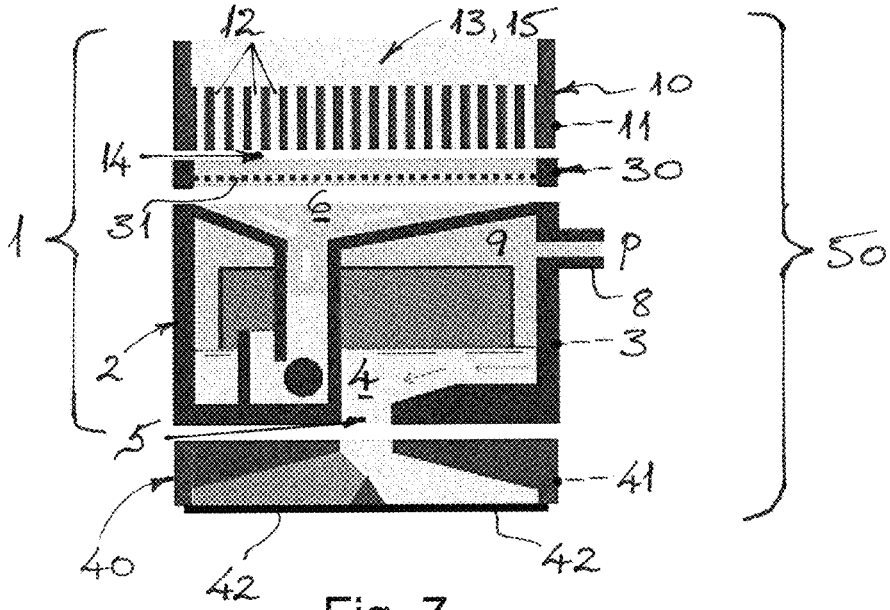
FIG. 7 is a cross-sectional side view of a print-head for a printing apparatus according to another preferred embodiment.

Referring now to the embodiments of drawing FIG. 5 and FIG. 7, it will be noted that examples of print-heads 50 for printing apparatus are shown which combine the ink supply system 1 described above with a respective drop-forming unit 40. The drop-forming unit 40 in this embodiment includes an intermediate assembly 41 and microelectromechanical system (MEMS) arranged on a chip 42 for generating or issuing ink droplets. The drop-forming unit 40 is supplied with ink 4 from the ink supply system 1, and specifically from the outlet 5 of the reservoir 2. Because the ink was pre-heated in the heating device 10 and held at a desired temperature within the reservoir 2, the ink entering the drop-forming unit 40 is within a very narrow range of a desired operating temperature. The ink flow from the reservoir 2 may be split or divided by a channel 43 internally within the drop-forming unit 40 for delivery to a suitable location of the MEMS chip 42, which is configured to form the drops to be printed on a print medium in a manner known by those skilled in the art and not explained here in detail.

Figure 8:
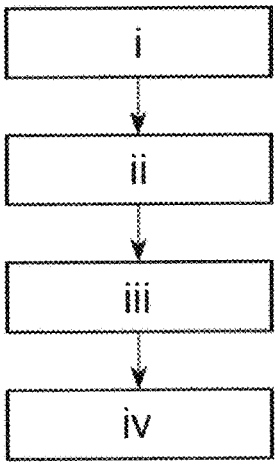
FIG. 8 is a flow diagram that schematically illustrates a method of supplying ink to a drop-forming unit according to a preferred embodiment.

Finally, with reference now to FIG. 8 of the drawings, a flow diagram is shown that schematically illustrates steps in a method of heating hot-melt ink in an ink supply system 1 according to an embodiment of the invention as described above with respect to FIGS. 1 to 7. In this regard, the first box i of FIG. 8 represents the step of providing liquid ink at a first temperature to a heating device 10 which comprises a monolithic heating body or block 11 having a plurality of channels 12 formed there-through. The second box ii represents a step of receiving the liquid ink an top side 13 of the heating body or block 11 in a receptacle 15 formed therein, wherein the heating body or block 11 is maintained at a second higher temperature which corresponds to a desired operating temperature for the ink. The third box iii then represents the step of passing or conveying the ink through the many channels 12 in the heating body or block 11 to raise the temperature of the ink to approach the second temperature. The final box iv in FIG. 8 represents the step of discharging the ink from the bottom side 14 of the heating body or block 11 and conveying the ink into the reservoir 2 via the inlet 6, preferably after passing a filter device 30.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 ink supply system
2 reservoir
3 housing
4 ink
5 reservoir outlet
6 reservoir inlet
7 valve means
8 port in the housing
9 free space
10 heating device
11 heating body or block
12 channel
13 top side of heating body
14 bottom side of heating body
15 receptacle, basin or trough
16 inlet opening of channel
17 passage
18 rim
19 cavity
20 melting device
21 tapered tube
22 central cavity of tube
30 filter device
31 filter member or mat
40 drop-forming unit
41 intermediate assembly
42 microelectromechanical system
43 channel
50 print-head

The invention claimed is:

1. A heating device for heating liquid ink in an ink supply system of a printing apparatus, comprising:

a heating body for transferring heat to liquid ink in contact with the heating body, wherein the heating body comprises an essentially solid body of thermally conductive material and includes a plurality of generally parallel channels formed therein which extend from a topside of the heating body to a bottom side of the heating body, wherein the heating body comprises a receptacle at the top side for receiving the liquid ink, wherein an inlet opening of each of the plurality of substantially parallel channels is formed in a base of the receptacle, wherein the heating device comprises a passage arranged separated from the receptacle and to provide a fluid connection between the top side and the bottom side of the heating body, which passage in operation provides pressure equalization between the top side and the bottom side of the heating body, and wherein the plurality of substantially parallel channels are arranged to, in operation, convey the liquid ink from the top side to the bottom side of the heating body whereby the ink is heated via contact with walls of the channels.

2. The heating device according to claim 1, wherein each of the plurality of substantially parallel channels has a length in the range of about 3 mm to about 10 mm.

3. The heating device according to claim 1, wherein each of the plurality of substantially parallel channels has a diameter in the range of about 0.2 mm to about 1.0 mm.

4. The heating device according to claim 1, wherein the number of the plurality of substantially parallel channels formed in the heating body is in the range of about 100 to about 500.

5. The heating device according to claim 1, wherein the passage is formed in the heating body.

6. An ink supply system for supplying ink to a drop-forming unit of a print-head in a printing apparatus, comprising:

a reservoir for holding a volume of liquid ink to be supplied to a drop-forming unit in a print-head; and the heating device according to claim 1 arranged upstream of the reservoir for heating the ink to a desired operating temperature, the heating device comprising a heating body for transferring heat to the ink, wherein the heating body comprises a plurality of channels which extend from the top side of the heating body to the bottom side of the heating body for conveying the ink to the reservoir, whereby the ink is heated via contact with walls of the channels.

7. The ink supply system according to claim 6, wherein the heating body comprises a substantially monolithic body of a thermally conductive material and wherein the plurality of channels are substantially parallel channels which extend through the heating body.

8. The ink supply system according to claim 6, further comprising a filter device which is arranged between the heating device and the reservoir, wherein the filter device is arranged at the bottom side of the heating body and at an inlet of the reservoir.

9. A print-head of a printing apparatus, comprising:

the ink supply system according to claim 6; and a drop-forming unit which is supplied with ink from an outlet of the reservoir.

10. The print-head according to claim 9, wherein the drop-forming unit comprises a MEMS; and/or wherein a second filtering device is provided to filter the ink from the ink supply system upstream of the drop-forming unit.

11. A printing apparatus comprising the ink supply system according to claim 6.

12. A printing apparatus comprising the print-head according to claim 9.

13. The heating device according to claim 2, wherein each of the plurality of substantially parallel channels has a diameter in the range of about 0.2 mm to about 1.0 mm.

14. The heating device according to claim 2, wherein the number of the plurality of substantially parallel channels formed in the heating body is in the range of about 100 to about 500.

15. The heating device according to claim 3, wherein the number of the plurality of substantially parallel channels formed in the heating body is in the range of about 100 to about 500.

16. The heating device according to claim 2, wherein the passage is formed in the heating body.

17. The heating device according to claim 3, wherein the passage is formed in the heating body.

18. The heating device according to claim 4, wherein the passage is formed in the heating body.

19. An ink supply system for supplying ink to a drop-forming unit of a print-head in a printing apparatus, comprising:

a reservoir for holding a volume of liquid ink to be supplied to a drop-forming unit in a print-head; and the heating device according to claim 2 arranged upstream of the reservoir for heating the ink to a desired operating temperature, the heating device comprising a heating body for transferring heat to the ink, wherein the heating body comprises a plurality of channels which extend from the top side of the heating body to the bottom side of the heating body for conveying the ink to the reservoir, whereby the ink is heated via contact with walls of the channels.

20. An ink supply system for supplying ink to a drop-forming unit of a print-head in a printing apparatus, comprising:

a reservoir for holding a volume of liquid ink to be supplied to a drop-forming unit in a print-head; and the heating device according to claim 3 arranged upstream of the reservoir for heating the ink to a desired operating temperature, the heating device comprising a heating body for transferring heat to the ink, wherein the heating body comprises a plurality of channels which extend from the top side of the heating body to the bottom side of the heating body for conveying the ink to the reservoir, whereby the ink is heated via contact with walls of the channels.

* * * * *